United States Patent [19]

Christophorou et al.

[11] Patent Number: 4,743,807

[45] Date of Patent: May 10, 1988

[54] LASER ACTIVATED DIFFUSE DISCHARGE SWITCH

[75] Inventors: Loucas G. Christophorou; Scott R. Hunter, both of Oak Ridge, Tenn.

[73] Assignee: The United States of America as represented by the United States Department of Energy, Washington, D.C.

[21] Appl. No.: 44,178

[22] Filed: Apr. 30, 1987

[51] Int. Cl.[4] ..... H01J 7/24; H05B 37/02

[52] U.S. Cl. ..... 315/150; 315/149; 315/156; 315/159; 315/358; 307/117; 307/139; 313/637; 313/643; 200/DIG. 36

[58] Field of Search ..... 315/149, 150, 156, 159, 315/358; 307/117, 139; 313/637, 643; 200/DIG. 36

[56] References Cited

U.S. PATENT DOCUMENTS

| | | | |
|---|---|---|---|
| 3,633,067 | 1/1972 | Dubois | 315/150 |
| 4,063,130 | 12/1977 | Hunter, Jr. | 315/150 |
| 4,401,920 | 8/1983 | Taylor et al. | 315/150 |
| 4,484,106 | 11/1984 | Taylor et al. | 315/150 |
| 4,490,650 | 12/1984 | Christophorou et al. | 315/150 |

FOREIGN PATENT DOCUMENTS

| | | | |
|---|---|---|---|
| 2099627 | 12/1982 | United Kingdom | 315/150 |

OTHER PUBLICATIONS

Schoenback et al, "An Optically Controlled Diffuse Discharge Switch," Digest of Technical Papers, Jun. 1-3, 1981, pp. 142-146.

Rossi, "Photoenhanced Electron Attachment of Vinylchloride and Trifluoroethylene at 193 nm," Appl. Phys. Lett. 47 (6), 15 Sep. 1985, pp. 576-578.

*Primary Examiner*—David K. Moore
*Assistant Examiner*—Michael J. Nickerson
*Attorney, Agent, or Firm*—Katherine P. Lovingood; Stephen D. Hamel; Judson R. Hightower

[57] ABSTRACT

The invention is a gas mixture for a diffuse discharge switch which is capable of changing from a conducting state to an insulating state in the presence of electrons upon the introduction of laser light. The mixture is composed of a buffer gas such as nitrogen or argon and an electron attaching gas such as $C_6H_5SH$, $C_6H_5SCH_3$, $CH_3CHO$ and $CF_3CHO$ wherein the electron attachment is brought on by indirect excitation of molecules to long-lived states by exposure to laser light.

6 Claims, 2 Drawing Sheets

LASER ACTIVATED DIFFUSE DISCHARGE SWITCH

This invention is an optical switch containing a gas mixture capable of rapidly removing free electrons from a system and was developed pursuant to a contract with the United States Department of Energy.

BACKGROUND

Recently there has been an increasing interest in the possibility of employing inductive energy storage in pulse power applications because of the high intrinsic capacity of such storage when compared with capacitive energy storage and also the fact that this energy can be transferred to the load in nanosecond time scales. The key to utilizing this technology is the availability of a repetitive fast opening switch. A leading contender for such an opening switch is the externally sustained diffuse gas discharge switch.

In a diffuse gas discharge switch, the diffuse discharge is substained by means of gas ionization either by an external electron beam, a laser beam or a combination of both. The fast opening of the switch is usually accomplished by adding an electronegative gas in the gas mixture which attaches the remaining electrons immediately after the external electron source is turned off. The switch opening time depends critically on the electron attachment properties of the electronegative gas. Laser induced enhancement of electron attachment could be used to minimize the switch opening time.

Enhanced electron attachment due to vibrationally excited ground electronic state molecules produced by laser irradiation has been investigated. However, this effect has an inherent disadvantage in the diffuse gas discharge switch in that these molecules can reach vibrational levels due to excitation caused by electron impact and thus lead to undesired electron attachment during the switch conduction phase. In contrast, electronically excited states have higher threshold energies and thus do not effect electron loss in the conduction phase. Therefore, there is a continuing need to provide gas mixtures for diffuse gas discharge switches that are capable of quickly removing free electrons from the switch when the switch is open but yet does not attach to electrons when the switch is closed.

SUMMARY OF THE INVENTION

In view of the above needs, it is an object of this invention to provide a process for fast switching that utilizes the ability of a molecule to capture low energy electrons upon being exposed to a laser light.

It is another object of this invention to provide a gas mixture capable of switching from a conducting state to an insulating state by optically enhanced electron attachment via indirect excitation of molecules to long lived states.

It is a further object of this invention to provide a diffuse discharge switch capable of fast switching. These and other objects will become obvious to persons skilled in the art upon study of the specifications and appended claims. The process of this invention is fast switching of a gas mixture from a conducting state to an insulating state by introducing an electron source to the gas mixture in the absence of light, the gas mixture being a buffered gas and an electron attaching compound. This mixture is in a gas chamber between two electrodes thereby creating a conducting environment within the chamber. To switch to the insulating environment, the external electron source is removed and the laser light is turned on thereby affecting the attachment of low energy electrons. The attachment is caused by the molecules of the compound first being excited to a high lying optically allowed state; second being internally converted to the lowest optically allowed state; and third undergoing intersystem crossing to the triplet state and then remaining in the triplet state for a relatively long time and capturing low energy electrons efficiently while in this triplet state. This compound in the triplet state is an extremely more efficient electron attaching medium than those previously used and can significantly improve the efficiency and speed of a switch. The invention is also a diffuse discharge switch containing a gas mixture of a buffer gas and an electron attaching gas, as well as the gas mixture itself.

DETAILED DESCRIPTION OF THE PREFERRED EMBODIMENT

Figure 1:
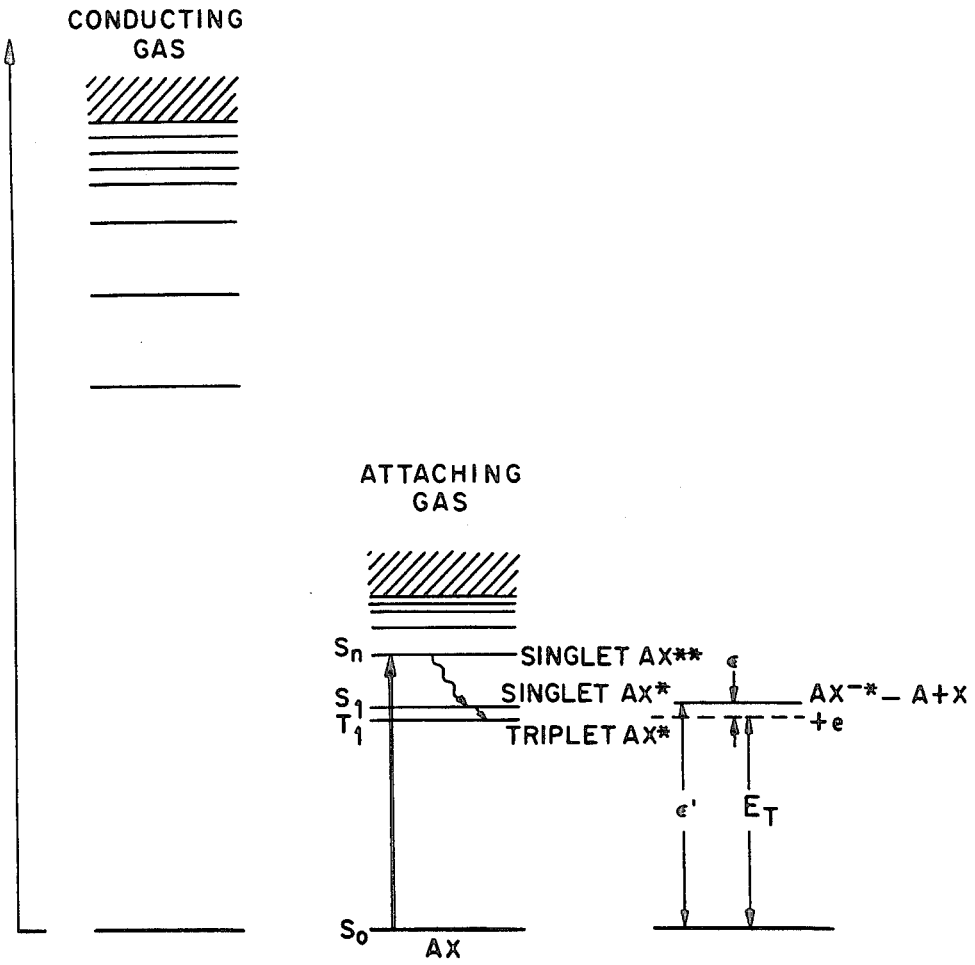
FIG. 1 is a schematic energy level diagram of the buffer and attaching gas system for the optical switch of this invention.

Previously various studies have been done on gas mixtures for the purpose of determining characteristics that make the mixtures conductors when the electron switch is closed and good insulators when open. Especially significant are the changes in the electron attaching properties of molecules with changes in their internal energy content since these can be employed to switch the electrical conduction properties to insulating properties. Efficient electron attachment results in a low concentration of free electrons and a high concentration of negative ions. Large changes in the cross section for negative ion formation have been observed when slow electrons collide with molecules excited thermally into vibrational/rotational states of the electronic ground state. Enhanced dissociative attachment via electron capture by vibrationally excited molecules produced by laser irradiation has also been reported. Additionally, enhanced electronic attachment to vibrationally excited HCl and HF molecules produced respectively by laser photo dissociation of $C_2H_3Cl$ and $C_2F_3H$ have been observed. The only studies known by the applicants on electron attachment to electronically excited molecules are the experiments on the dissociative attachment to $O_2$ produced in a microwave discharge and the calculation of dissociative attachment cross section for $H_2$. Both of these studies indicated larger attachment cross sections for the electronically excited molecules compared to the ground state molecule. These two molecules were excited by direct electron impact of the ground state molecule into the metastable state using microwave discharges for $O_2$, and a glow discharge plasma source for $H_2$. No laser enhancement of the electron attachment process in these two molecules is possible as no direct or indirect (i.e., intersystem crossing) photo absorption mechanisms exist in these two molecules which will produce long lived metastable states. The novelty of this invention lies in process of electron attachment involving electronically excited molecules and its significance for optical switching.

Certain molecules possess the ability, when exposed to laser light, to be electronically excited to a high lying optically allowed transition state before being internally converted to the lowest optically allowed state and then undergoing intersystem crossing to the triplet state. While in the triplet state, the molecules possess the ability to capture low energy electrons extremely efficiently and this triplet state is maintained for relatively long periods of time. Thus, such molecules are extremely efficient for capturing electrons after a switch is opened thereby interrupting the current. Compounds that undergo such transitions are ones that possess $\pi$ electrons, two specific types of compounds being

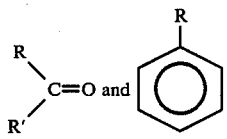

where R and R' are radicals and the laser specific wavelengths to provide the excitation of the compounds are determined by each particular compound. Compounds and wavelengths can be determined by examining the optical absorption spectrum of the molecule under consideration, and from a knowledge of the positions of the lowest lying singlet and triplet state, and the quantum efficiency for conversion of the lowest lying singlet state into the metastable triplet state. The absorption spectrum will indicate the optimum laser wavelength to use to obtain the maximum light absorption in the gas, while knowledge of the quantum efficiency will indicate the number of molecules that are produced in the excited triplet state.

The principle of this invention and the required properties of the electron attaching molecules, herein refered to as AX, are shown in FIG. 1, an energy level diagram of a gas mixture of a buffer and attaching gas wherein the attaching gas is $C_6H_5SH$, $CH_3CHO$ and other similar compounds having a distinctive feature of their lowest electronic states being long lived. The electron attachment properties of AX are brought about by exposing AX at the ground state, $S_o$, to an excimer laser beam to excite the molecules via the single photon absorption to a strongly allowed electronic singlet state, $S_n$, designated AX which lies below the lowest excited electronic state of the buffer gas. The AX molecule normally undergoes fast intramolecular relaxation to its first singlet state, $S_1$, in about $10^{-13}$ seconds, designated AX*. This AX* species then undergoes rapid intersystem crossing to the lowest triplet state, $T_1$, in about $10^{-8}$ to $10^{-11}$ seconds depending on the molecule. AX** remains in the triplet state for a relatively long period of time, greater than a 100 nanoseconds, an ample amount of time to allow collisions with slow electrons.

Classes of molecules that have the characteristics required are certain benzene derivatives and certain carbonyl compounds. In the first group, compounds that are effective are thiophenol ($C_6H_5SH$) and thioanisole ($C_6H_5SCH_3$) and in the second group specifically identified are acetyaldehyde ($CH_3CHO$) and trifluoroacetaldehyde ($CF_3CHO$). Photoexcitation into a highly allowed $\pi \rightarrow \pi^*$ singlet state very quickly converges into the lowest excited triplet state with unit efficiency. The life times of the lowest electronically excited states are more than $10^{-7}$s, quite long enough for low energy electron capture and subsequent attachment.

Figure 2:
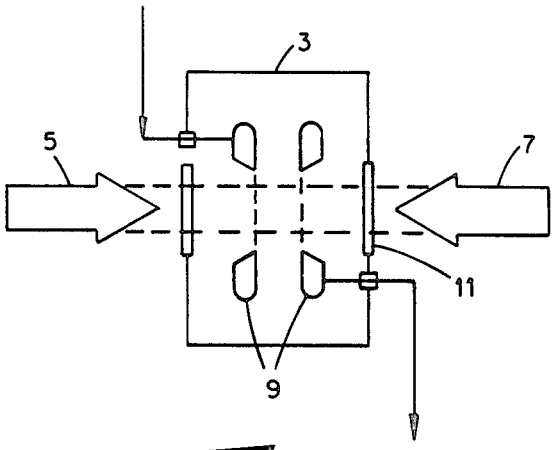
FIG. 2 is a schematic diagram of a typical optical switch application.

FIG. 2 illustrates a typical diffuse discharge switch within which this gas mixture would be used. A gas mixture of a buffer gas such as $N_2$ or Ar is within the chamber 3 with an electron attaching gas with a partial pressure usually between 0.01 to 1.0 torr. When the electron beam 5 is turned on and the laser 7 is off, the electricity is conducted using the electrodes 9 to maintain an uniform field. To turn the switch off, the electron beam 5 is removed and a laser 7 is fired through a laser window 11 into the chamber 3. The electron attaching compound absorbs the light and, by the above described process, captures electrons in the chamber thereby removing the free flow of electrons and converting the gas into an insulator.

Figure 3:
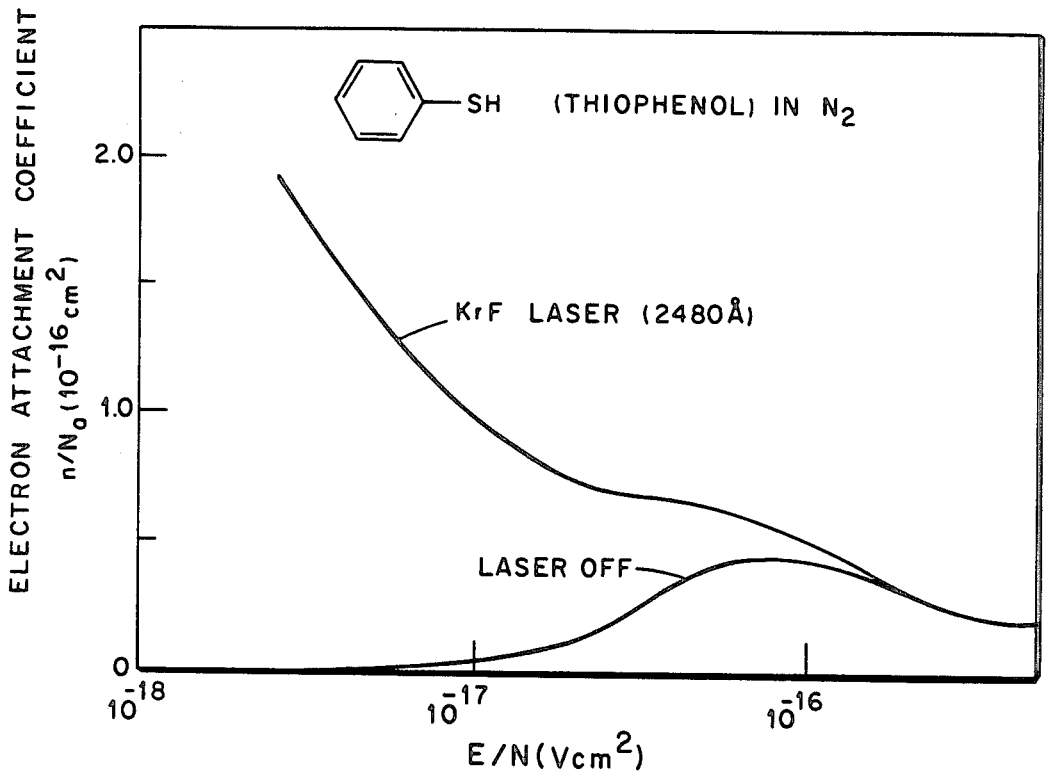
FIG. 3 illustrates the observed photoenhanced electron attachment of thiophenol.

FIG. 3 illustrates the observed increase in the electron attachment coefficient of thiophenol versus the density reduced electric field (E/N) using KrF laser beam of 2480 Å. It is shown that at low E/N and hence at low electron energies, the laser has a dramatic effect on the rate of electron attachment in the mixture.

We claim:

1. A process for fast switching of a gas from a conducting state to an insulating state comprising:

in the absence of light, introducing an electron source to a gas mixture of a buffer gas contained in said switch that is an inert, nonelectron attaching, high vapor pressure gas with the lowest excited state lying at energies above the laser photon energy and a compound which attaches electrons when electronically exicted, said mixture being in a gas chamber containing two electrodes, thereby creating an conducting environment within said chamber;

removing said electron source;

directing a laser light at said gas mixture thereby affecting the attachment of low energy electrons, wherein said electron attachment is caused by the molecules of said compound, first, being optically excited to a high lying optically allowed transition state, second, being internally converted to the lowest optically allowed state, third, undergoing intersystem crossing to the triplet state, remaining in the triplet for a relatively long time and capturing low energy electrons efficiently while in the triplet state.

2. The process of claim 1 wherein said compound is $C_6H_5SH$, $C_6H_5SCH_3$, $CH_3CHO$, or $CF_3CHO$.

3. A diffuse discharge switch comprising: a chamber containing a gas mixture of a buffer gas that is inert, nonelectron attaching, high vapor pressure gas with the lowest excited state lying at energies above the laser photon energy and a compound which attaches electrons when elec tronically excited by molecules of said compound first being optically excited to a high lying optically allowed transition state second, being internally converted to the lowest optically allowed state, third, undergoing intersystem crossing to the triplet state, remaining in the triplet state for a relatively long time and capturing low energy electrons efficiently while in the triplet state; an electron source; two electrodes; and a means for transporting an electric current through said chamber.

4. A diffuse discharge switch claim 3, wherein said gas mixture is $C_6H_5SH$, $C_6H_5SCH_3$, $CH_3CHO$ or $CF_3CHO$.

5. A gas mixture for fast switching in a diffuse discharge switch comprising a buffer gas contained in said switch that is an inert, nonelectron attaching, high vapor pressure gas with the lowest excited state lying at energies above the laser photon energy and a compound that when exposed to a laser light the molecules of said compound, first, are optically excited to a high lying singlet state, second, are internally converted to the lowest optically allowed state and, third, undergo intersystem crossing to the triplet state and remain in the triplet state for a relatively long time.

6. The gas mixture claim 5 wherein said compound is $C_6H_5SH$, $C_6H_5SCH_3$, $CH_3CHO$, or $CF_3CHO$.

* * * * *